US011284723B2

(12) United States Patent
Wu et al.

(10) Patent No.: US 11,284,723 B2
(45) Date of Patent: Mar. 29, 2022

(54) SEAT PAD ASSEMBLY WITH VENTILATION

(71) Applicants: Qiankun Wu, Moreno Valley, CA (US); David Yunsong Guo, Irvine, CA (US)

(72) Inventors: Qiankun Wu, Moreno Valley, CA (US); David Yunsong Guo, Irvine, CA (US)

( * ) Notice: Subject to any disclaimer, the term of this patent is extended or adjusted under 35 U.S.C. 154(b) by 0 days.

(21) Appl. No.: 17/106,056

(22) Filed: Nov. 27, 2020

(65) Prior Publication Data

US 2021/0076827 A1 Mar. 18, 2021

Related U.S. Application Data

(60) Provisional application No. 62/942,093, filed on Nov. 30, 2019.

(51) Int. Cl.
*A47C 7/02* (2006.01)

(52) U.S. Cl.
CPC ..... *A47C 7/021* (2013.01)

(58) Field of Classification Search
CPC ..... A47C 7/021; A47C 7/0213; B60N 2/56; B60N 2/5607; B60N 2/5621; B60N 2/5642; B60N 2/565; B60N 2/5657
USPC ..... 297/452.42
See application file for complete search history.

(56) References Cited

U.S. PATENT DOCUMENTS 5,226,188 A * 7/1993 Liou ..... A47C 7/742 297/452.46
2007/0277313 A1* 12/2007 Terech ..... A47C 7/74 5/421
2012/0315132 A1* 12/2012 Axakov ..... B60N 2/565 415/182.1
2017/0099953 A1* 4/2017 Harte ..... A47C 7/021
2019/0329681 A1* 10/2019 Tait ..... B60N 2/5628
2020/0231428 A1* 7/2020 Migneco ..... B29C 64/10
2020/0361276 A1* 11/2020 Bima ..... B62J 50/30

FOREIGN PATENT DOCUMENTS

CN 211493743 * 9/2020

* cited by examiner

*Primary Examiner* — Mark R Wendell
(74) *Attorney, Agent, or Firm* — Barry Choobin; Patent 360

(57) ABSTRACT

Disclosed is a seat pad assembly having ventilation for comfort and heat dissipation. The seat pad assembly includes a frame with padding on top of the frame. The padding having multiple pores for the air to pass through. The frame includes a side opening on its sidewall and a front opening on its front wall. A channel fluidly connects the first opening to the second opening. A cooling module having fans is coupled to the first opening. The top of the frame is having apertures along the length of the channel, wherein the channel and the apertures are configured, such as an airflow between the first opening and the second opening results in drawing the air from the pores of the padding through the apertures into the channel. Alternatively, the channel and the apertures can be configured to draw a portion of the air flowing between the first opening and the second opening through the apertures into the pores of the padding.

19 Claims, 11 Drawing Sheets

SEAT PAD ASSEMBLY WITH VENTILATION

CROSS-REFERENCE TO RELATED APPLICATIONS

This application claims priority to the U.S. provisional patent application Ser. No. 62/942,093, filed on Nov. 30, 2019, which is incorporated herein by reference in its entirety.

FIELD OF INVENTION

The present invention relates to seat pad assembly, and particularly, the present invention relates to a ventilated seat pad assembly.

BACKGROUND

The cushioned seat pads are quite common nowadays for providing a comfortable sitting posture, particularly on a hard surface. The seat pads are ergonomic in design and cushioned to provide extra comfort. Seat pads are recommended for desktop settings to prevent fatigue and pain.

Although the existing seat pads are of ergonomic design that provides comfort, all known seat pads suffer from one major drawback. The seat pads, because of their cushioning and ergonomic design, lack ventilation resulting in heat build-up in the sitting area of a user, particularly, in the user's groin area. When a user sits on a conventional seat pad, the body weight of the user reduces or eliminates the room for free airflow, thus resulting in the accumulation of heat and sweat. The conventional seat pads utilize a flat or slightly curved surface that tends to be thermally insulated, which tends to trap heat in the central region where the human body contacts the seat surface.

Accumulation of heat at the inner thighs may cause discomfort for both men and women. Overheating in men's testicles and testes may lead to infertility. For a woman, a sweaty vagina can create an environment for bacterial and yeast overgrowth.

Thus, a need is there for an improved seat pad assembly that addresses the aforementioned drawbacks of conventional seat pads. A need is there for a seat pad assembly that has ventilation to prevent the heat buildup.

SUMMARY OF THE INVENTION

The principal object of the present invention is therefore directed to a seat pad assembly with ventilation for dissipating the heat.

It is another object of the present invention that the seat pad assembly provides for cooling the groin area of a user.

It is still another object of the present invention that the seat pad assembly is of an ergonomic design.

It is yet another object of the present invention that the seat pad assembly is comfortable for sitting.

It is an additional object of the present invention that the seat pad assembly is economical to manufacture.

In one aspect, disclosed is a seat pad assembly configured to provide active cooling or passive cooling for thighs, underneath the legs, and groin of a person sitting on the disclosed seat pad assembly. The disclosed seat pad assembly includes a rigid frame, one or more cooling modules housed in the frame, and one or more air paths/channels configured within the frame for providing a path for airflow. The disclosed seat pad assembly also includes ergonomic paddings on top of a rigid frame. The top of the frame is having several apertures and the padding also made of soft fabric which is porous enough for air to flow across freely.

In one aspect, the airflow within the interior structure of the seat pad assembly is designed to flow parallel to the upper seating surface. Airflow in parallel to the seating surface is beneficial in that it creates a pressure gradient to extract the air and moisture above the seating surface making sitting on the seat pad comfortable and cool. The user may not notice or feel air flowing underneath the legs, thighs, or the groin area. Such an airflow design is referred to herein as passive cooling. The disclosed assembly removes any heat in the sitting area of the human body that contacts the seat pad assembly.

In another embodiment, the disclosed seat pad assembly can be designed for the perpendicular airflow in a direction to the seating surface. Airflow in this direction may provide faster and instant relief to the user and will produce a noticeable effect immediately upon activation. This application may be useful for athletes, race car drivers, and others who may be participating in some physical activities, which require a more dramatic cooling option. This type of airflow design is referred to herein as the active cooling.

In one aspect, the seat pad assembly can be designed to provide both active cooling and passive cooling, wherein the proportion of active cooling and passive cooling can be adjusted manually. Alternatively, the disclosed seat assembly may also allow switching between the active cooling and the passive cooling.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying figures, which are incorporated herein, form part of the specification and illustrate implementations of the present invention. Together with the description, the figures further explain the principles of the present invention and to enable a person skilled in the relevant arts to make and use the invention.

DETAILED DESCRIPTION

Figure 1:
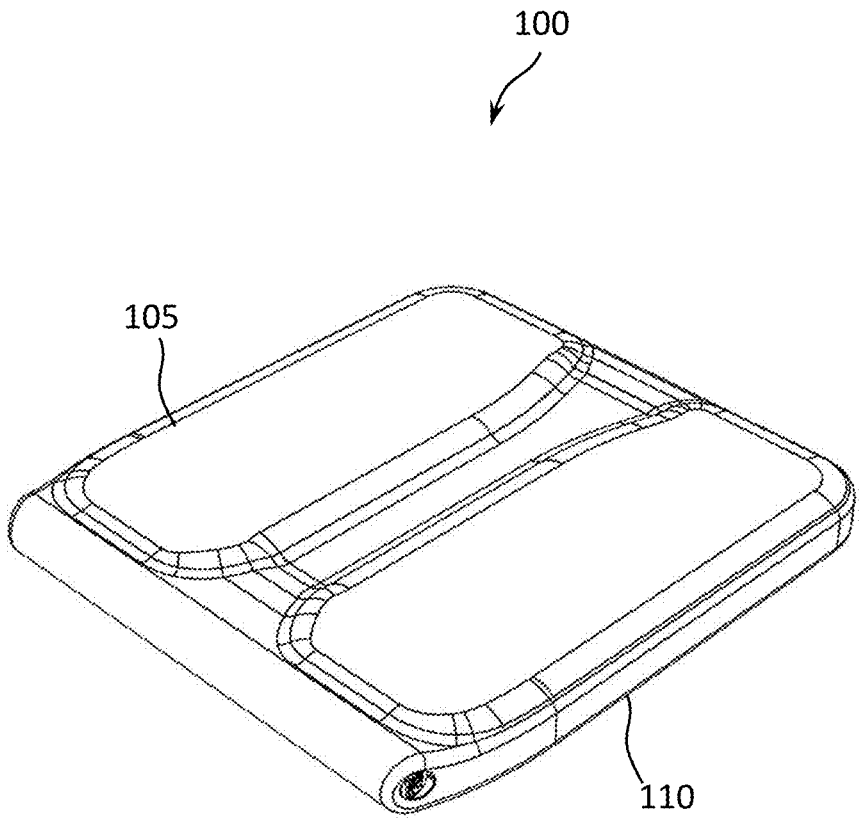
FIG. 1 is a perspective view of the seat pad assembly, according to an exemplary embodiment of the present invention.

Subject matter will now be described more fully hereinafter. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as apparatus and methods of use thereof. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention since the scope of the invention will be best defined by the allowed claims of any resulting patent.

The following detailed description is described with reference to the drawings, wherein like reference numerals are used to refer to like elements throughout. In the following description, for purposes of explanation, specific details may be set forth in order to provide a thorough understanding of the subject innovation. It may be evident, however, that the claimed subject matter may be practiced without these specific details. In other instances, well-known structures and apparatus are shown in block diagram form in order to facilitate describing the subject innovation. Moreover, the drawings may not be to scale.

Referring to FIGS. 1 to 8 which shows an exemplary embodiment of the present invention i.e. a seat pad assembly 100. The seat pad assembly is having a padding 105 and a frame 110. The padding can be applied on top of the frame for cushioning. The padding can be of an ergonomic design for comfort while sitting on the disclosed seat pad assembly. Moreover, the padding can be made of a soft material having pores that allow air to pass through. Alternatively, spaced apart pores can be provided in the padding for the air. The disclosed seat pad can be used with seating, such as a chair, to provide more comfort and less heat in a sitting area of the human body. As can be seen in FIG. 1, the disclosed seat pad assembly can be designed to have an elongated and compact configuration. The frame of the seat pad assembly can be rigid and durable to withstand the weight of a person sitting on the seat pad assembly. Moreover, the frame should not bend or collapse by the applied weight on the frame when a person sits on the disclosed seat pad assembly. The frame can be made of solid metal or plastic.

Figure 2:
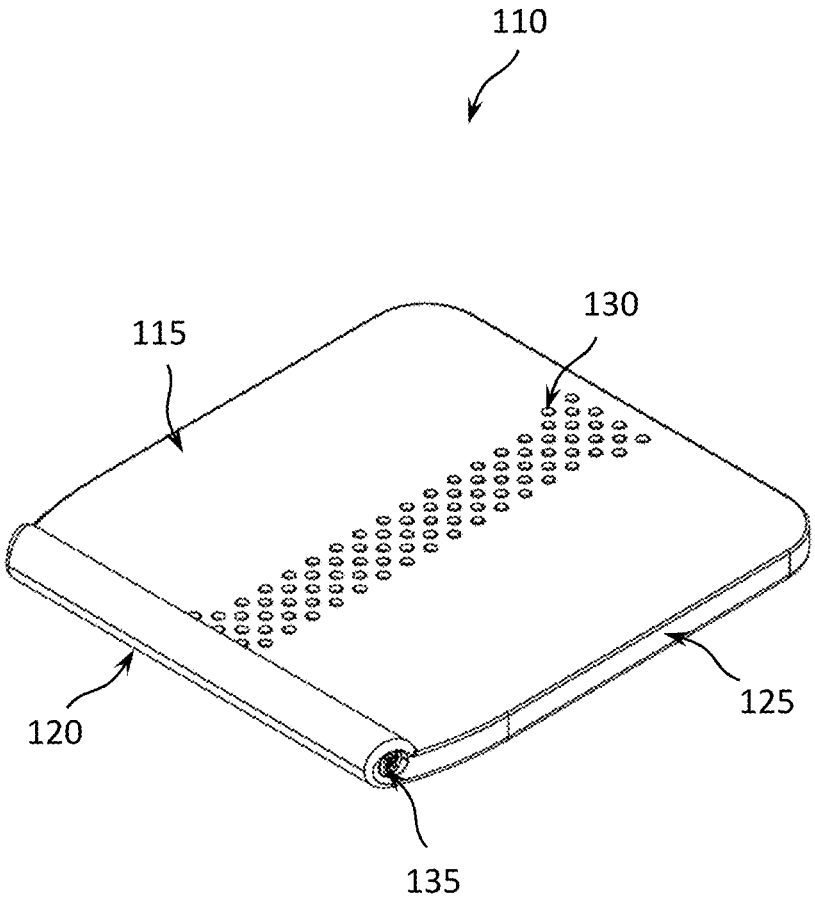
FIG. 2 shows the frame of the seat pad assembly of FIG. 1.
Figure 3:
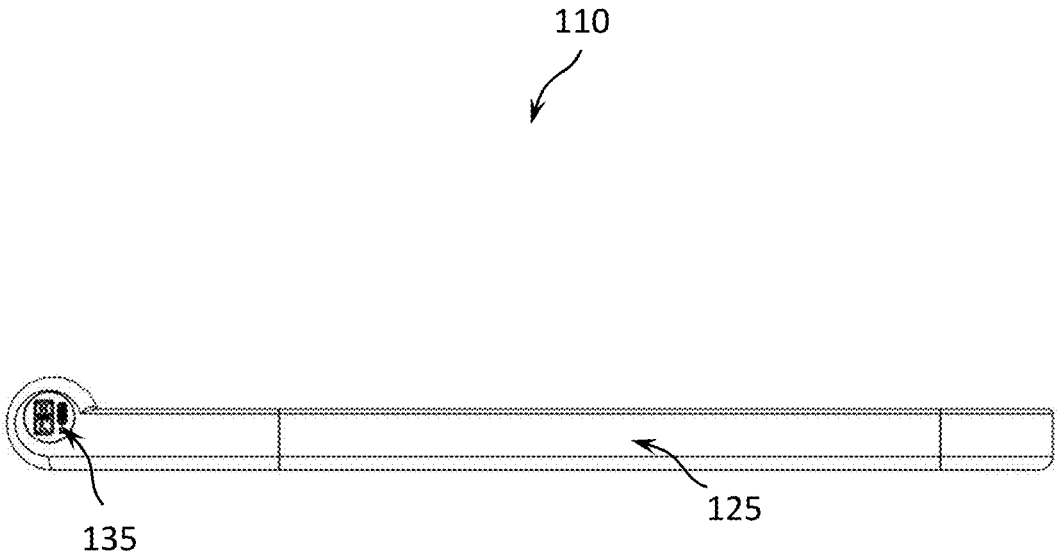
FIG. 3 shows the right side of the frame of FIG. 2.

Referring to FIG. 2-9, FIG. 2 is an isometric view of frame 110. The frame 110 can have a top 115, a bottom 155, a front-side 170, a rear side 120, a left side 150, and a right side 125. The frame shown in FIG. 2 is of a compact cuboid configuration. The bottom of the frame can be flat shown in FIG. 3. The bottom of the frame can be flat to place the disclosed seat pad assembly on a seating, such as a chair. Alternatively, the bottom of the frame can be of a shape that increases the stability of the disclosed seat pad assembly on a seating. Additionally, the seat pad assembly can have straps to hold the seat pad assembly on a seating surface.

Figure 4:
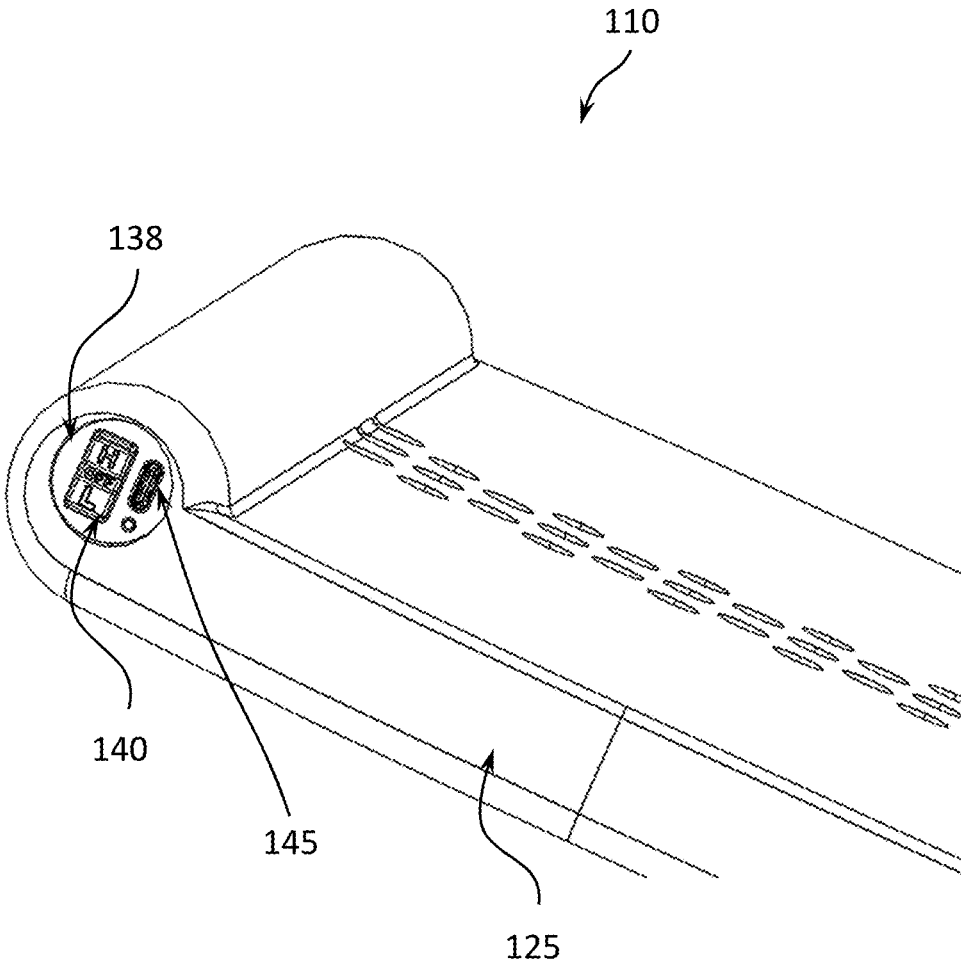
FIG. 4 shows enlarged view of a rear portion of the seat pad assembly for clarity.

The rear side 120 of the frame shown in FIG. 2 is slightly elevated and cylindrical in shape. It is to be understood that the rear side of the frame can be in plane with the top of the frame and can be of any shape, such as polygonal or cuboid. Moreover, the rear side portion can be elevated further at an angle to provide support for a person sitting. The cylindrical rear side 120 of frame 110 is having opposite ends along the right side 125 and the left side 150 of the frame. On the right end of the cylindrical rear side is a control module 135. An opening 138 can be provided in the wall of the frame through which the control module is accessible from outside the frame. The control module is housed within the frame and coupled to the opening in the frame. More clearly, seen in FIG. 3 and FIG. 4, the control module is having a switch and a charging port. FIG. 4 shows the control module having a switch 140 and a charging port 145. The switch can be used to regulate the power supply to a cooling module also housed in the frame. The switch shown in FIG. 4 is having three options i.e. high, off, and medium. The high option can be used to set the cooling module to a high level. Similarly, the low option can be used to set the cooling module to a low level. The off option can be used to turn the cooling module on and off. The control module can also include a battery to power the cooling module. The battery can be charged through the charging port 145 shown in FIG. 4. Additionally, the cooling module can also be externally powered and the charging port 145 may allow for connecting with an external power supply.

It is to understand that FIG. 4 shows the control module on the right end of the cylindrical rear side of the frame. However, the control module can be provided on any other spot on the frame. For example, the control module can be on the side of the frame. The frame shown in the FIGS. 1-8 has one cooling module 165 opposite to the control module. However, two or more cooling modules are within the scope of the present invention. In the case of two cooling modules, one cooling module can substitute the control module to another position.

Figure 5:
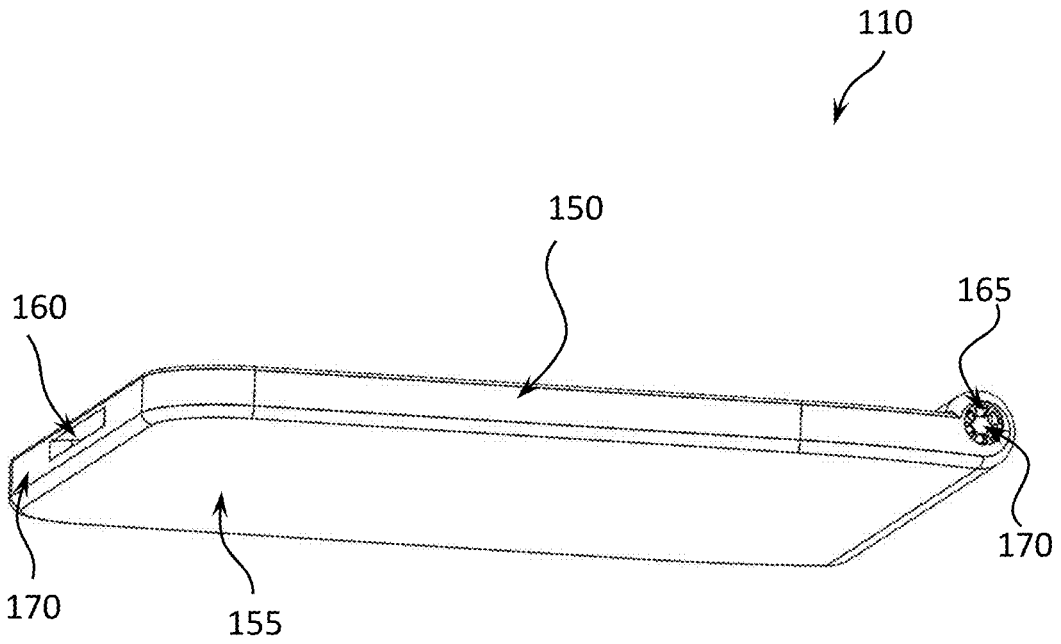
FIG. 5 shows the left side of the frame of FIG. 2.

FIG. 5 shows the other side i.e. the left side of frame 110. Near the end of the left side can be seen the cooling module 165. The left side 150 of the frame near the end is having an opening 170. The cooling module 165 is coupled to the opening 170. The cooling module can be an electrical device that can blow air. In one case, the cooling module can include one or more fans. The two or more fans can be coupled in a series one after another. One or more fans can either blow air out through the opening or can draw air into the frame. In one case, the fans can be a dual-mode fan that can be manually switched between the two modes. In the first mode, the air can blow out from the frame through the opening. In the second mode, the fans can rotate in the reverse direction, sucking the air from outside through the opening. The cooling module can be controlled by the control module described above. The control options can include turning the fans on and off and changing the speed of the fans. The seat pad assembly can be provided with one or two of such cooling modules. In one case, the two cooling modules can install on opposite ends of the cylindrical rear side of the frame.

Figure 6:
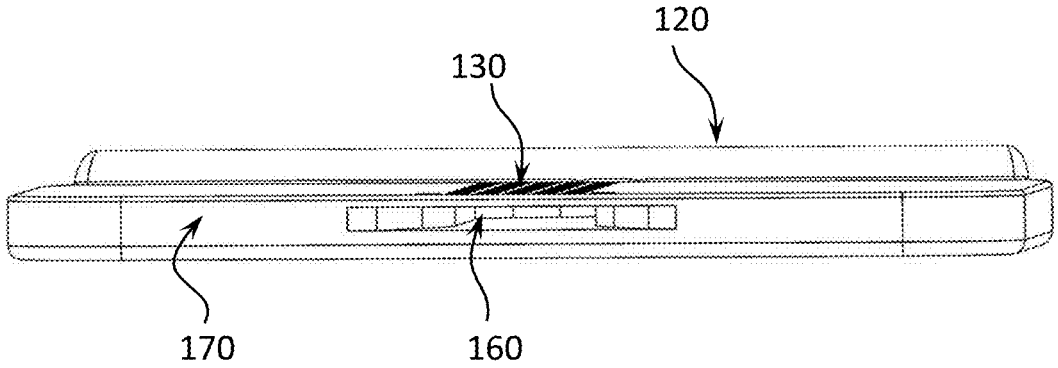
FIG. 6 shows the front side of the frame of FIG. 2.

FIG. 5 also shows a second opening 160 in the mid of the front side 170 of the frame 110. The second opening 160 is elongated and fluidly connected to the opening 170. The cooling module 165 results in airflow between the opening 170 and the opening 160. In one case, the air drawn by the cooling module 165 through the opening 170 flows along a channel within the frame and blows out through the opening 160. In another case, the air can be drawn through the opening 160 by the cooling module 165, and the air is blown out through the opening 170. FIG. 6 shows the depth of the front opening 160. The inner volume of the frame can be hollow or solid. In case, the inner volume is hollow, the air blown by the cooling module can pass through the front opening.

The frame shown in FIG. 6 is having a solid inner volume and a channel connects the front opening 160 to the side opening 170 of the frame 110. The channel can be an L-shaped channel having one end formed by the side opening 170 while the channel ends at the front opening 160. When the frame is having two cooling modules on the opposite ends of the cylindrical rear side of the frame, the channel can be of a T-shape i.e. a channel having three ends formed by the front opening and the two side openings of the frame. Two cooling modules couple to the two side openings. Air can flow between the two side openings and the front opening. Depending on the mode of the cooling module, the air can be blown out from the front opening or the air can be drawn in the front opening.

Figure 7:
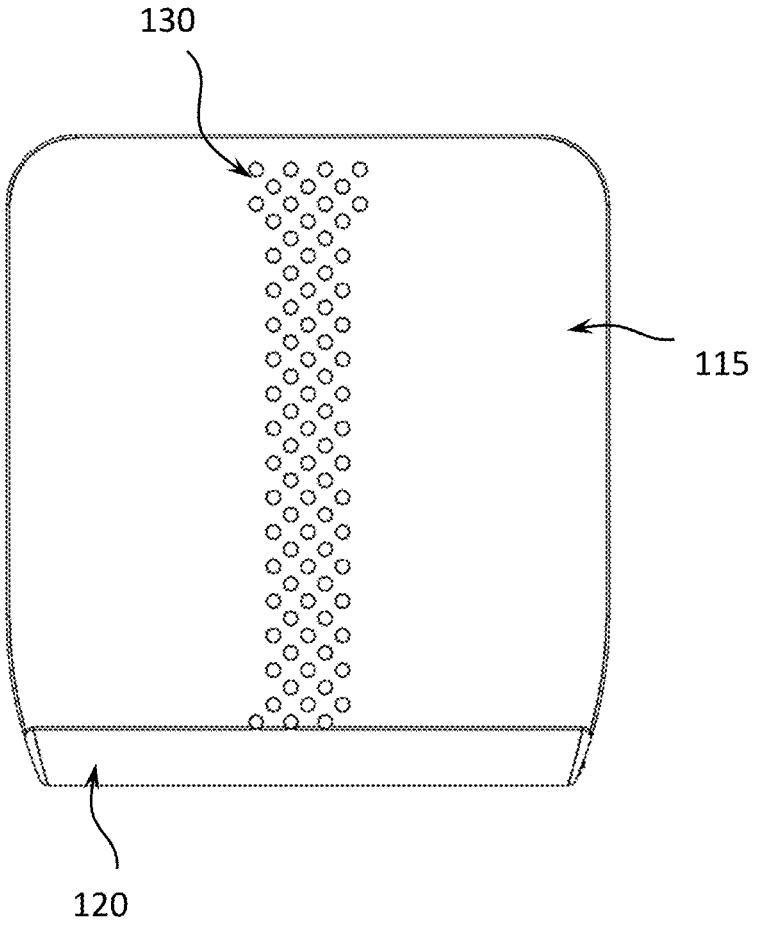
FIG. 7 shows the top of the frame of FIG. 2.
Figure 8:
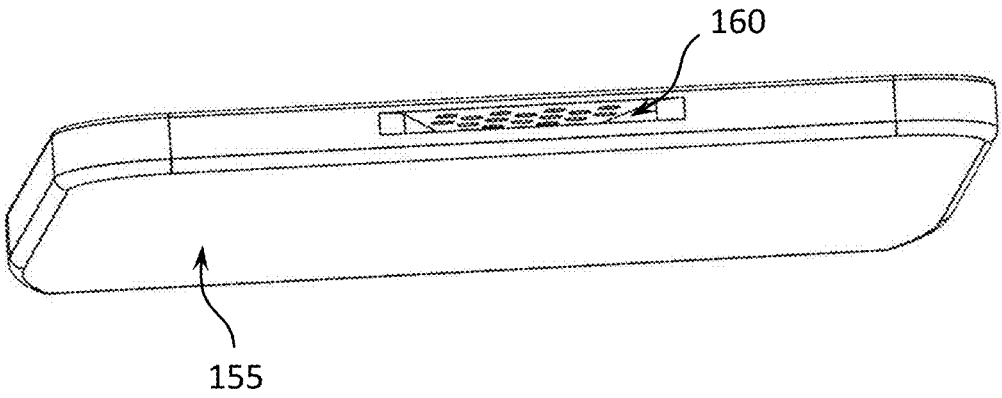
FIG. 8 is a front perspective view of the frame of FIG. 2.
Figure 9:
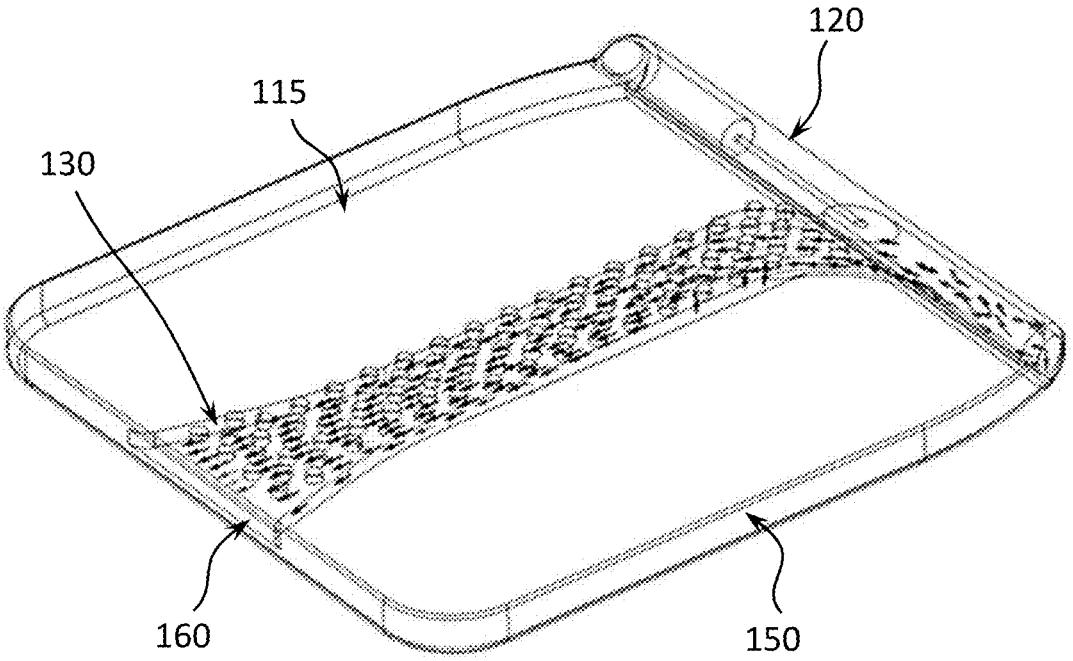
FIG. 9 shows the flow of air using arrows along the channel within the frame of FIG. 2.
Figure 10:
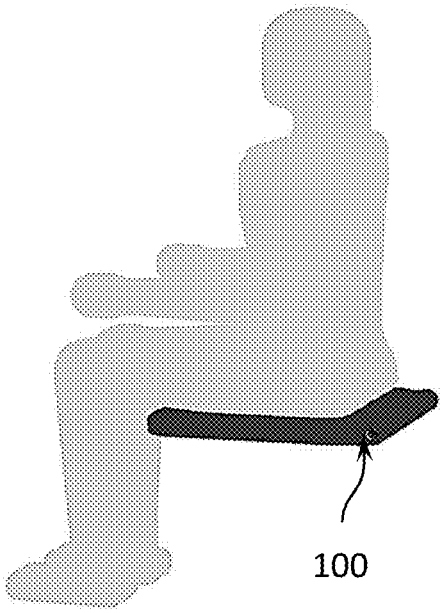
FIG. 10 demonstrates a person sitting on the disclosed seat pad assembly shown in FIG. 1.

The frame is also having a number of apertures on its top side. FIG. 2 shows the apertures 130 on the top and along the length of a channel. FIG. 7 is a top view of the frame showing the apertures. The apertures open in the channel as shown in FIGS. 6 and 8. Air can be drawn by the fans from outside through the side opening. The drawn air travels along the channel and is blown outside the frame through the front opening. The path of the air can be nearly parallel to the top side of the frame, In FIG. 9, arrows show the direction of the air starting from the side opening and blowing out through the front opening taking an L-path. Such an airflow in parallel to the seating surface is beneficial in that it creates a pressure gradient to extract the air and moisture above the seating surface making contact with the human body comfortably, in which the user may not notice or feel air flowing underneath the legs, thighs, and the groin area. This is evident by the few arrows displayed that are perpendicular to the top surface, which simulates the vertical air exchange to cool the vital area. The disclosed assembly removes any heat in areas of the human body in contact with the seat pad assembly. FIG. 10 shows a person sitting on the disclosed seat pad assembly 100. The cylindrical rear side portion having the fans in behind the person. This prevents any damage to the cooling module that may be caused by the weight applied by sitting on the seat pad.

In one embodiment, the channel and the apertures can be shaped such as to draw a portion of the air flowing in the channel between the front side opening and the rear side opening of the frame. This air can provide active cooling. Alternatively, the front side opening 160 can be closed forcing the air to leave through the apertures. This flow has been referred to herein as the perpendicular flow. Airflow in this direction may provide faster and instant relief to the user and will produce a noticeable effect immediately upon activation. This application may be useful for athletes, race car drivers, and others who may be participating in some physical activities, which require a more dramatic cooling option. This type of airflow design may be considered as providing active cooling.

Figure 11:
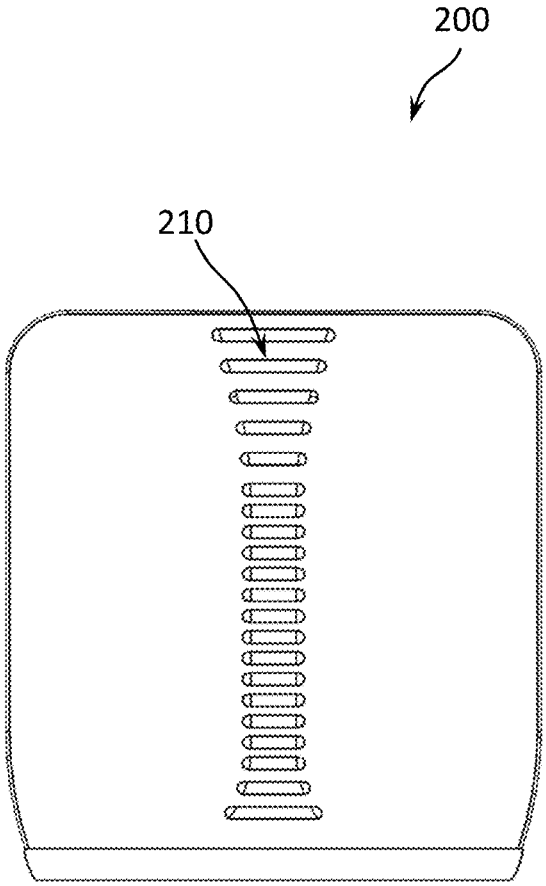
FIG. 11 shows another embodiment of the frame having elongated apertures arranges in a row along the length of the channel, according to an exemplary embodiment of the present invention.

FIG. 11 shows an alternate embodiment of frame 200 having different apertures 210. The apertures 210 are elongated and arranged in a row along the length of the channel within the frame. The series of apertures are parallel and conforms to the shape of the padding. The bigger apertures may allow more air to pass through.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A seat pad assembly comprising:

a frame having a top, a bottom, and upstanding walls defining an inner volume of the frame;

a first opening and a second opening in the upstanding walls;

a channel within the frame and fluidly connecting the first opening to the second opening;

a cooling module coupled to the first opening, the cooling module configured to blow air outside the frame from the channel through the first opening or draw air from the outside into the channel through the first opening;

a plurality of apertures in the top of the frame along a length of the channel; and a padding on top of the frame, the padding having pores for air to pass through, wherein the second opening is configured to switch between an open state and a closed state, in the open state air can pass through the second opening, in the closed state air cannot pass through the second opening.

2. The seat pad assembly according to claim 1, wherein the channel and the apertures are configured such as the flow of air between the first opening and the second opening draws air from the padding through the apertures.

3. The seat pad assembly according to claim 1, wherein the channel and the apertures are configured such as a portion of air is drawn by the apertures into the padding from the air flowing between the first opening and the second opening.

4. The seat pad assembly according to claim 1, wherein the cooling module comprises one or more fans, the one or more fans configured to draw air from the outside into the channel.

5. The seat pad assembly according to claim 1, wherein the cooling module comprises one or more fans, the one or more fans configured to blow air outside through the first opening.

6. The seat pad assembly according to claim 1, wherein the second opening is in the closed state and the air is blown through the apertures into the pores of the padding.

7. The seat pad assembly according to claim 1, wherein the second opening is in the closed state and the air is drawn through the apertures from the pores of the padding.

8. The seat pad assembly according to claim 1, wherein the upstanding walls include a front wall, a rear wall, and opposite side walls.

9. The seat pad assembly according to claim 8, wherein the first opening is on a first side wall of the opposite side walls, the second opening is on the front wall, the channel is an L-shaped channel.

10. The seat pad assembly according to claim 9, wherein the seat pad assembly further comprises a third opening, the third opening is on a second side wall of the opposite side wall, the second side wall is opposite the first side wall, a second cooling module coupled to the third opening, the channel is a T-shaped channel that fluidly connects the first opening, the second opening, and the third opening.

11. The seat pad assembly according to claim 10, wherein the rear wall is configured as a cylindrical portion having opposite ends, the first opening is on one end of the opposite ends that is along the first side wall, the third opening is on the other end of the opposite ends.

12. The seat pad assembly according to claim 9, wherein the seat pad assembly further comprises a third opening, the third opening is in a second side wall of the opposite side wall, the second side wall is opposite the first side wall, a control module within the frame is coupled to the third opening.

13. The seat pad assembly according to claim 12, wherein the control module includes a switch to regulate a power supply to the cooling module.

14. The seat pad assembly according to claim 13, wherein the control module comprises a battery for powering the cooling module.

15. The seat pad assembly according to claim 9, wherein the seat pad assembly further comprises a plurality of branch channels and a plurality of openings configured in the upstanding walls, the plurality of branch channels fluidly connects the channel with the plurality of openings.

16. The seat pad assembly according to claim 9, wherein the rear wall is configured as a cylindrical portion having opposite ends, the first opening is on one end of the opposite ends that is along the first side wall.

17. The seat pad assembly according to claim 16, wherein the cylindrical portion is elevated upwards forming an arched support.

18. A seat pad assembly comprising:

a frame having a top, a bottom, and upstanding walls defining an inner volume of the frame;

a first opening and a second opening in the upstanding walls;

a channel within the frame and fluidly connecting the first opening to the second opening;

a cooling module coupled to the first opening, the cooling module configured to blow air outside the frame from the channel through the first opening or draw air from the outside into the channel through the first opening;

a plurality of apertures in the top of the frame along a length of the channel; and a padding on top of the frame, the padding having pores for air to pass through, wherein the upstanding walls include a front wall, a rear wall, and opposite side walls, wherein the first opening is on a first side wall of the opposite side walls, the second opening is on the front wall, the channel is an L-shaped channel, wherein the seat pad assembly further comprises a third opening, the third opening is on a second side wall of the opposite side wall, the second side wall is opposite the first side wall, a second cooling module coupled to the third opening, the channel is a T-shaped channel that fluidly connects the first opening, the second opening, and the third opening.

19. A seat pad assembly comprising:

a frame having a top, a bottom, and upstanding walls defining an inner volume of the frame;

a first opening and a second opening in the upstanding walls;

a channel within the frame and fluidly connecting the first opening to the second opening;

a cooling module coupled to the first opening, the cooling module configured to blow air outside the frame from the channel through the first opening or draw air from the outside into the channel through the first opening;

a plurality of apertures in the top of the frame along a length of the channel; and a padding on top of the frame, the padding having pores for air to pass through, wherein the upstanding walls include a front wall, a rear wall, and opposite side walls, wherein the first opening is on a first side wall of the opposite side walls, the second opening is on the front wall, the channel is an L-shaped channel, wherein the rear wall is configured as a cylindrical portion having opposite ends, the first opening is on one end of the opposite ends that is along the first side wall.

* * * * *